United States Patent [19]

Deffner et al.

[11] Patent Number: 4,785,943

[45] Date of Patent: Nov. 22, 1988

[54] EXPANDABLE STORAGE AND DISPENSING SYSTEM

[75] Inventors: John F. Deffner, Lisle; Jack H. Michaelis, Hoffman Estates, both of Ill.

[73] Assignee: Visual Marketing, Inc., Chicago, Ill.

[21] Appl. No.: 939,741

[22] Filed: Dec. 9, 1986

[51] Int. Cl.[4] ..... A47F 7/00

[52] U.S. Cl. ..... 211/59.2; 211/128; 206/602

[58] Field of Search ..... 211/59.2, 59.4, 128, 211/188, 194, 49.1, 126; 248/DIG. 9; 206/602; 312/45

[56] References Cited

U.S. PATENT DOCUMENTS

| | | | |
|---|---|---|---|
| 2,623,641 | 12/1952 | Shield . | |
| 2,888,145 | 5/1959 | Knott et al. . | |
| 3,019,907 | 2/1962 | Belejack . | |
| 3,152,697 | 10/1964 | Berman et al. . | |
| 3,180,288 | 4/1965 | McCowan | 211/126 X |
| 3,194,620 | 7/1965 | Sauer . | |
| 3,279,618 | 10/1966 | Bergstedt . | |
| 3,784,022 | 1/1974 | Beesley, Jr. . | |
| 3,999,663 | 12/1976 | Walter et al. | 248/DIG. 9 X |
| 4,006,824 | 2/1977 | Snediker et al. . | |
| 4,105,126 | 8/1978 | Deffner et al. . | |
| 4,228,903 | 10/1980 | Eckert . | |
| 4,356,923 | 11/1982 | Young et al. . | |
| 4,474,297 | 10/1984 | Zucker . | |
| 4,593,823 | 6/1986 | Fershko et al. | 211/49.1 |
| 4,598,828 | 7/1986 | Young et al. . | |

OTHER PUBLICATIONS

Mead Stacker Tracker TM/Single-Tracker—pp. MM-39, MM-40.

*Primary Examiner*—Ramon S. Britts
*Assistant Examiner*—Sarah A. Lechok Eley
*Attorney, Agent, or Firm*—Willian Brinks Olds Hofer Gilson & Lione Ltd.

[57] ABSTRACT

Two embodiments of a modular storage and dispensing rack for dispensing articles are disclosed. The first embodiment is a rack with a top and bottom shelf, while the second embodiment is a rack with only one shelf. The shelves normally have between five and nine discrete tray modules, wherein the tray modules are fixed in a side-by-side relationship to form the shelves. The tray modules each have a top side for storing articles and a bottom side having saddles that are designed to receive connecting members. The first embodiment has connecting members fabricated from square steel tubing. These connecting members pass through the saddles of the tray modules in opposite directions and overlap. The overlapping connecting members are fixed relative to the tray modules so that the tray modules remain fixed in a side-by-side relationship to form a shelf. The top shelf is supported above the bottom shelf with spacing members fabricated from square tubing. The second embodiment utilizes tie bars to fix the tray modules in a side-by-side relationship to form a shelf. The tie bars pass through the saddles of the tray modules and are fixed relative to the tray modules to that the tray modules are fixed in a side-by-side relationship. Each tie bar has weakened areas which facilitate portions of the bar to be broken off, so that the length of the tie bar will correspond to the number of tray modules forming the shelf.

10 Claims, 5 Drawing Sheets

FIG. 9
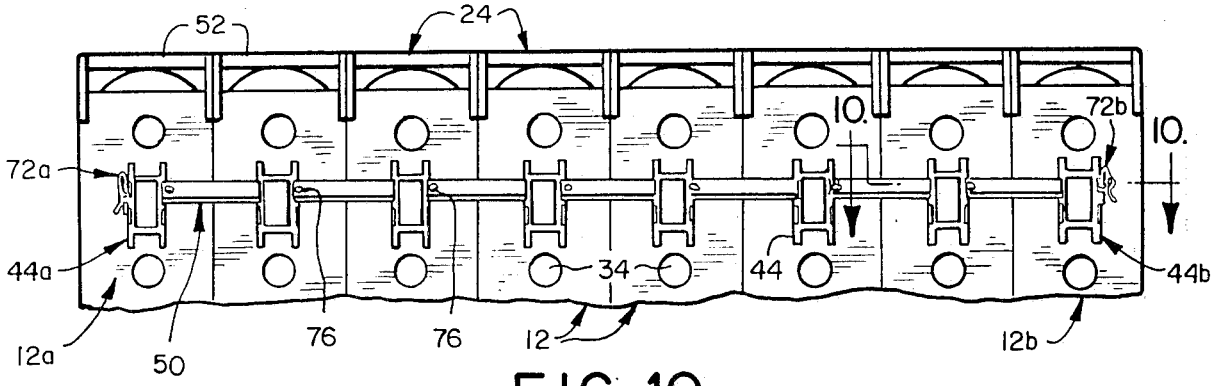
FIG. 10
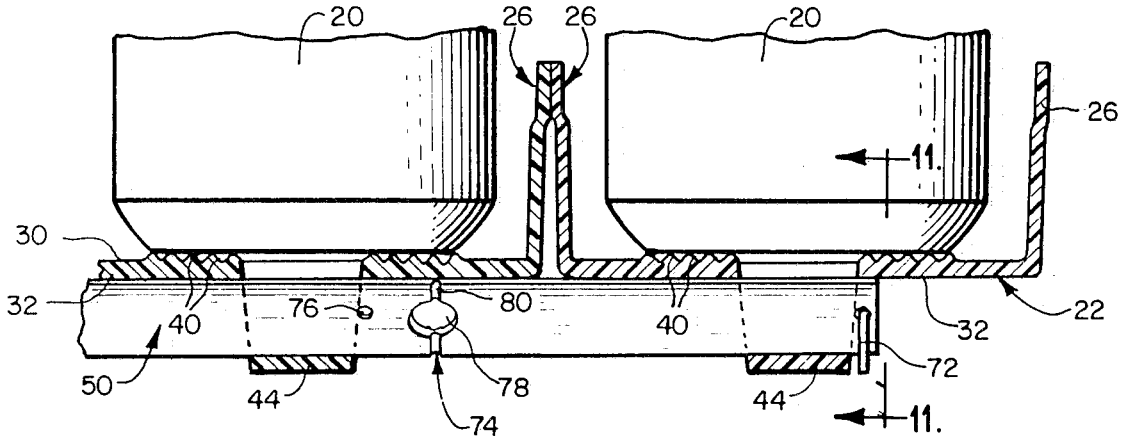
FIG. 11
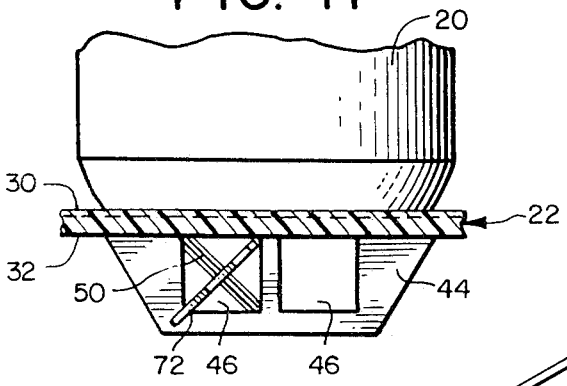
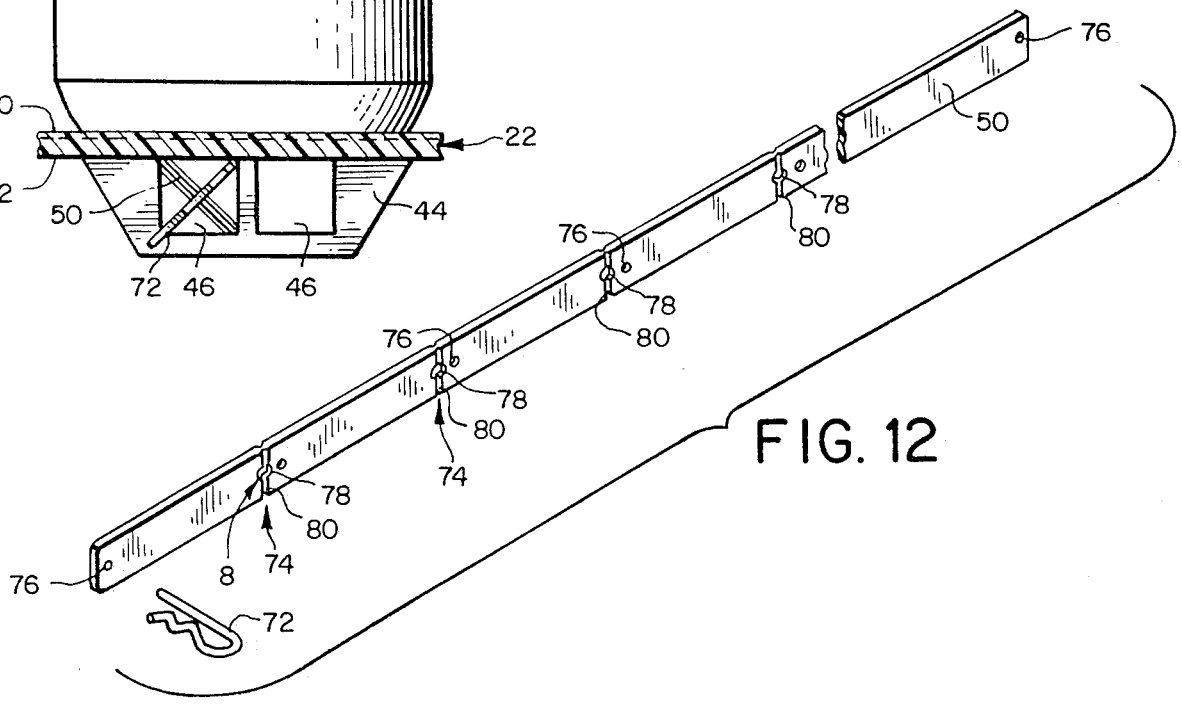
FIG. 12

EXPANDABLE STORAGE AND DISPENSING SYSTEM

BACKGROUND OF THE INVENTION

The present invention relates to modular storage and dispensing racks such as those used for storing and dispensing articles in supermarkets and other merchandising establishments More particularly, the present invention is directed to an improved modular rack for storing and dispensing articles such as bottles or cans, wherein the improvement is designed to permit faster and easier assembly, disassembly and modification of the rack.

Modular storage and dispensing racks are known in the art. For example, U.S. Pat. Nos. 3,194,620, 3,152,697 and 4,598,828 disclose modular storage and dispensing racks.

U.S. Pat. Nos. 3,194,620 and 3,152,697 disclose racks for storing and dispensing cylindrical articles on their sides. The shelves of the racks are inclined so that the cylindrical articles stored on the shelves will roll to the front of the racks where they are accessible to a customer or user.

The rack disclosed in U.S. Pat. No. 3,194,620 is constructed by horizontally stacking a number of dispenser units in such a manner as to provide a generally integrated structure. Each individual dispenser unit is divided into a number of open-ended compartments for receiving and storing batteries. Each dispenser unit also has mating members arranged in aligned pairs on opposite sides of the dispenser unit. The mating members form an interlocking connection between adjacent dispensers when the dispensers are stacked horizontally. Normally, the mating members are made out of plastic.

One drawback with the storage and dispensing unit disclosed in U.S. Pat. No. 3,194,620 is that the plastic mating members are prone to break off during assembly and disassembly of the rack. Another drawback with this storage and dispensing unit is the presence of unused mating and interlocking members on the right and left ends of the completed unit. To avoid this drawback, either the unused mating and interlocking members must be broken off or special end dispensers must be used on the right and left ends of the unit.

The rack disclosed in U.S. Pat. No. 3,152,697 is constructed from modular devices used for displaying, storing and dispensing a plurality of cylindrical articles. The modular devices are horizontally stacked in such a manner as to provide a generally integrated assembly. Each modular device has two parallel side walls which support internal runways or tracks. The runways or tracks are arranged so that cylindrical articles stored on the runways or tracks are accepted at the top of the modular device and directed by the runways or tracks toward the discharge area of the modular device. The modular devices also have openings in their side walls. These openings are designed to allow bolts to pass through the modular device. The bolts are used to fix adjacent modular devices next to each other to form an integrated assembly.

One drawback with the rack disclosed in U.S. Pat. No. 3,152,697 is the use of bolts to fix adjacent modular devices next to each other to form an integrated assembly of modular devices. This is a drawback because the length of the bolts vary depending on the number of modular devices intended to be included in a given assembly. Thus, when the number of modular devices in the assembly is changed the bolts must also be changed.

The U.S. Pat. No. 4,598,828 discloses a rack for storing or dispensing bottles or cans in an upright position. The rack is constructed from shelves and side members, and is horizontally expandable. Each shelf includes a plurality of flanges. The flanges extend from each opposing side of the shelf and are designed to be received within a plurality of apertures located in the side members. A completed rack includes at least two side members which are interconnected by at least one shelf. The flanges of the shelf snap into the apertures of the side members to interconnect the side members and fix them in a parallel relationship. To expand the rack, at least one additional shelf and one additional side member are needed. The flanges of the shelf are snapped into the apertures of one of the side members of the rack to be expanded, and then the additional side member is attached to the unsupported side of the shelf. This form of expansion allows almost unlimited horizontal expansion of the rack.

One drawback with the rack disclosed in U.S. Pat. No. 4,598,828 is that the flanges for supporting the tray modules between side members are normally made out of plastic. Thus, they are also prone to break off during assembly and disassembly of the rack.

Other examples of storage and dispensing racks that can be varied in size are The Stacker-Tracker TM and Single-Tracker made by Mead. The Stacker-Tracker TM and Single-Tracker racks store and dispense bottles or cans in an upright position. The shelves of the racks are usually inclined so that the bottles or cans will slide to the front of the rack where they are accessible to a customer. These shelves are molded from plastic and designed so that their top surface consist of ten parallel tracks. Four of the ten tracks are designed so that they can be broken off. The shelf is molded so that two tracks on each end of the shelf are not as rigidly attached to the shelf as the six center tracks. This makes it easier to break the end tracks off. The purpose of the end tracks is to allow the shelves of the Stacker-Tracker TM and Single-Tracker shelves to be narrowed.

The Stacker-Tracker TM has two shelves. The top shelf is supported above the bottom shelf with two vertical support members located on each side of the shelves. Each support member has a horizontal leg attached to its top end and a horizontal leg attached to its bottom end. The bottom leg of each support member attaches to the bottom side of the bottom shelf and the top leg of each support member attaches to the bottom side of the top shelf. The length of the legs of the support members are such that they only attach to the bottom of a shelf for a distance approximately equal to the width of three tracks. Consequently, the support members do not overlap, and do not directly support the center portion of the top shelf.

One drawback with the Mead racks is the inability to increase the width of the racks once they are narrowed. Once a tray module is broken off, it cannot later be easily reconnected to the shelf.

SUMMARY OF THE INVENTION

The present invention is directed to an expandable storage and dispensing rack.

According to the invention, the storage and dispensing rack includes at least one shelf. Each shelf includes a plurality of discrete tray modules and a connector means. Each discrete tray module has a top side for storing and dispensing articles and a bottom side attached to a connector receiving means. The connector means passes through the connector receiving means of a plurality of discrete tray modules so that those discrete tray modules are joined in a side-by-side relationship to form a shelf.

In a first preferred embodiment of the invention, the storage and dispensing rack has top and bottom shelves. The shelves have between five and nine discrete tray modules, wherein the discrete tray modules are fixed in a side-by-side relationship to form the shelves. The discrete tray modules each have a top side for storing and dispensing cans or bottles and a bottom side having a first and second saddle. The saddles are designed to receive connecting members fabricated from square steel tubing. Four connecting members are used to fix the discrete tray modules in the side-by-side relationship to form each shelf. The four connecting members pass through the saddles of the discrete tray modules and cooperate to fix the discrete tray modules in a side-by-side relationship. The connecting members of the top shelf have end portions bent in a downward direction, and the connecting members of the bottom shelf have end portions bent in an upward direction. The top shelf is supported above the bottom shelf by four spacing members. A spacing member is slid onto each of the four end portions of the connecting members of the bottom shelf. The top shelf is then aligned above the bottom shelf so the four end portions of the connecting members of the top shelf slide into the respective spacing member located on the connecting members of the bottom shelf.

In a second preferred embodiment of the invention, the storage and dispensing rack has a single shelf. Between five and nine discrete tray modules are joined by a first tie bar and a second tie bar, in a side-by-side relationship, to form the shelf. Each discrete tray modules has a top side for storing and dispensing cans or bottles and a bottom side having a first and second saddle. Each saddle is designed to receive a tie bar fabricated from flat bar. The first tie bar passes through the first saddles of the tray modules, and the second tie bar passes through the second saddles of the tray modules. Each tie bar has a plurality of weakened areas which allow the tie bar to be broken off to a length corresponding to the number of tray modules to be included in the shelf. The tie bars are then fixed relative to the tray modules with hinge pins so that the tray modules remain joined in a side-by-side relationship to form a shelf.

The first and second embodiments of the rack are designed to permit faster and easier assembly, disassembly and modification than prior approaches.

The first embodiment of the rack is designed so that the width of the rack is modified by adding or removing tray modules. After adding or removing tray modules the connecting members are adjusted so that contact between adjacent tray modules is maintained. Once each connecting member is in place, relative to the tray modules, two screws are inserted into each connecting member so that the heads of the screws rest against the first saddle and the last saddle the connecting member passes through. This relationship between the screws and saddles prevents relative motion between the connecting members and tray modules.

The second embodiment of the rack is designed so that the width of the rack is modified by removing tray modules. After removing the desired number of tray modules the tie bars are shortened so that contact between adjacent tray modules is maintained. The tie bars are shortened by breaking off predetermined portions of the tie bars. Once the tie bars are shortened, the tie bars are inserted into the saddles of the tray modules and hinge pins are inserted in the tie bars. The hinge pins are inserted into the tie bar so that they abut the outside edges of the saddles on the first and last tray modules in the shelf. This relationship between the hinge pins and saddles prevents relative motion between the tie bars and tray modules.

The use of connecting members and tie bars for joining tray modules in the present invention overcomes the problem of flange breakage as found in the racks disclosed in U.S. Pat. Nos. 4,598,828 and 3,194,620. In addition,, the use of connecting members and tie bars overcomes the problem of using bolts for joining tray modules as found in the rack disclosed in U.S. Pat. No. 3,194,620. Finally, the use of connecting members and tie bars for joining tray modules overcomes the problem of limited width reduction found in the Stacker- Tracker TM and Single-Tracker TM racks. The use of connecting members also overcomes the problem of inexpandability found in the Stacker-Tracker TM and Single-Tracker.

The invention itself, together with further objects and attendant advantages, will best be understood by reference to the following detailed description taken in conjunction with the drawings.

BRIEF DESCRIPTION OF THE DRAWINGS

FIG. 9 is a bottom view of a second preferred embodiment of the present invention having only one shelf.

FIG. 10 is a cross-sectional view of FIG. 9 taken along line 10—10.

FIG. 11 is a cross-sectional view of the tray module in FIG. 10 taken along line 11—11.

FIG. 12 is a perspective view of a tie bar utilized to join the tray modules of the storage and dispensing rack shown in FIGS. 9–11.

DETAILED DESCRIPTION OF THE PREFERRED EMBODIMENTS

Figure 1:
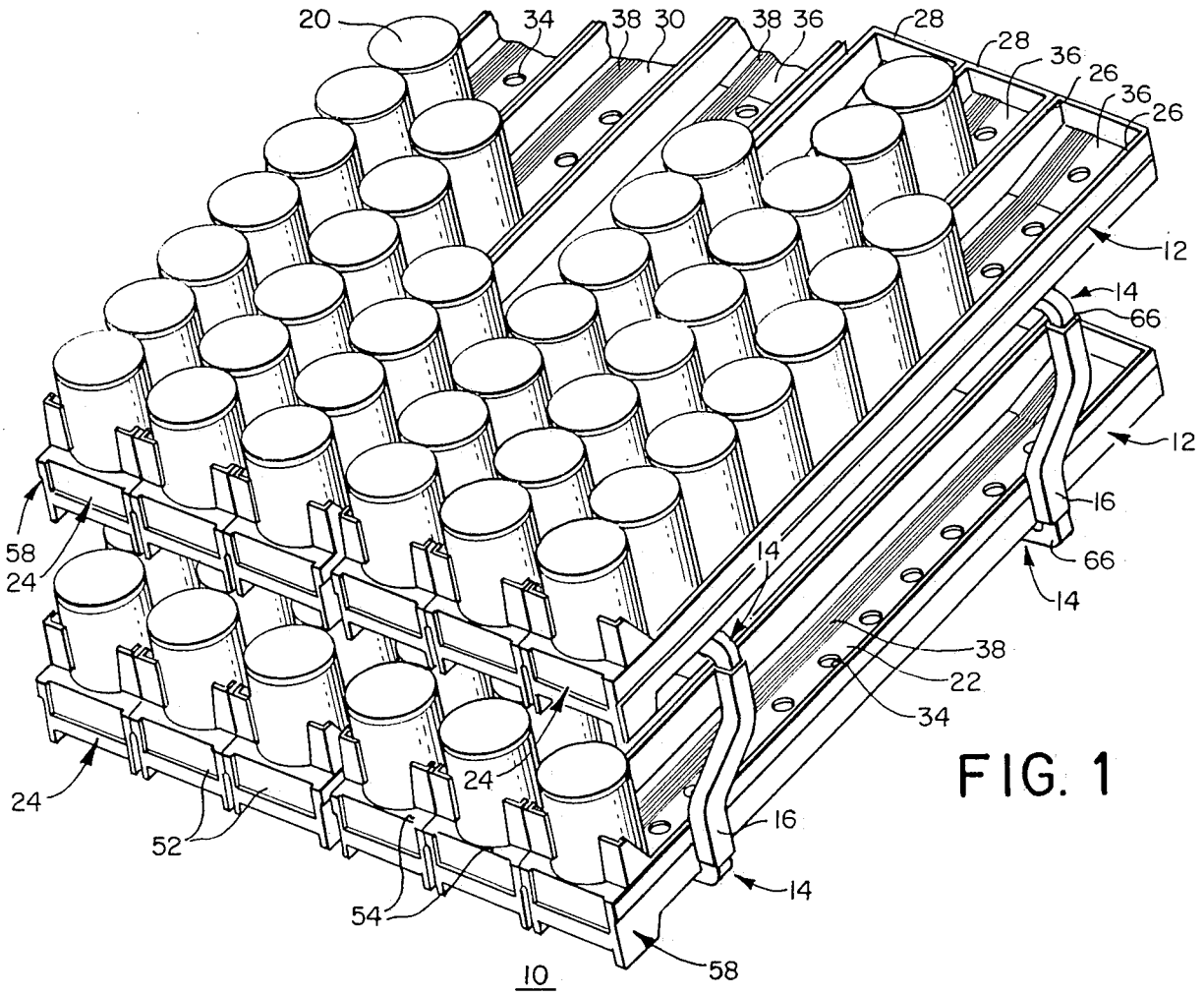
FIG. 1 is a perspective view of a first preferred embodiment of the storage and dispensing rack of the present invention having two shelves stacked one on top the other.
Figure 2:
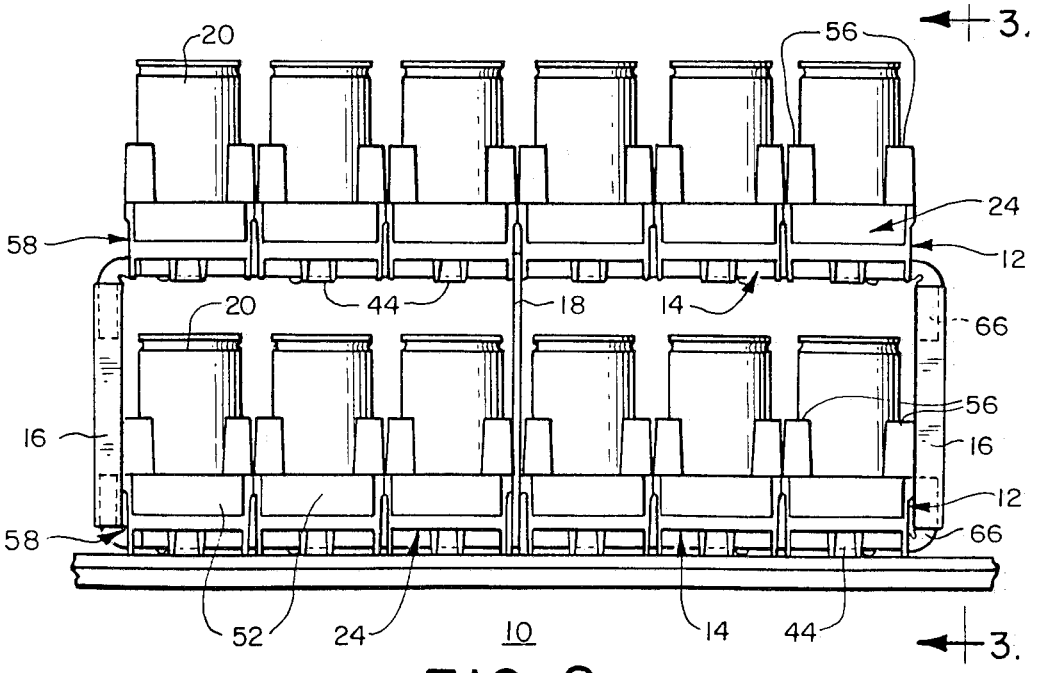
FIG. 2 is a front elevational view of the storage and dispensing rack of FIG. 1.
Figure 3:
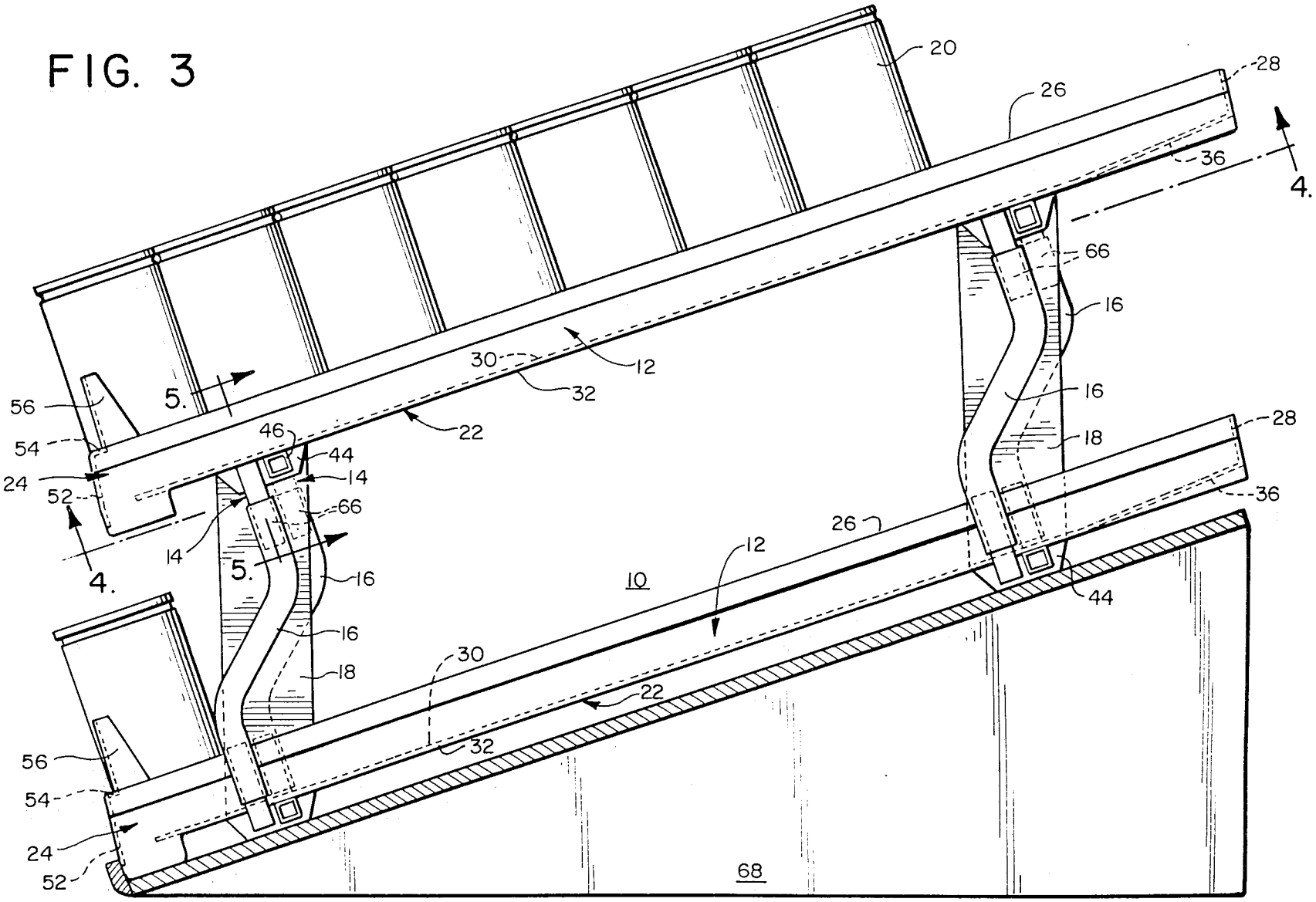
FIG. 3 is a side elevational view of the storage and dispensing rack of FIG. 2 taken along lines 3—3.

Turning to the drawings, FIGS. 1, 2 and 3 illustrate a first preferred embodiment of the storage and dispensing rack 10 of the present invention. The storage and dispensing rack 10 shown in FIG. 1 has twelve discrete tray modules 12, eight connecting members 14, four spacing members 16 and two separating members 18. The storage and dispensing rack 10 is designed to store and dispense articles such as bottles, cans 20 or other containers, hereinafter generally referred to as cans 20. As will be more fully described below, the storage and dispensing rack 10 is specifically designed to be easily and efficiently assembled, disassembled and modified.

Figure 5:
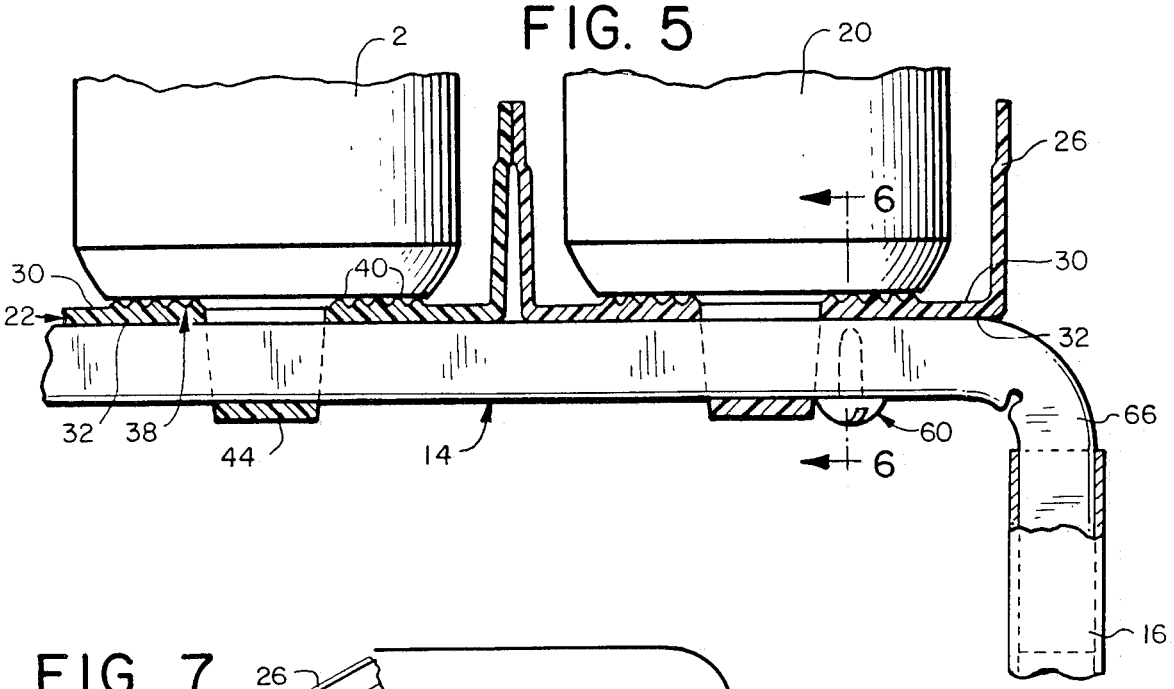
FIG. 5 is a cross-sectional view of the storage and dispensing rack of FIG. 3 taken along line 5—5.

FIG. 1 shows twelve discrete tray modules 12 fixed together to form two shelves 58 of the rack 10. The tray modules 12 are "discrete," inasmuch as they will not maintain a fixed relationship with other "discrete" tray modules 12 unless another structure is present to join one "discrete" tray module 12 with another "discrete" tray module 12 in a fixed relationship. Or in other words, each discrete tray module 12 is a self-sufficient, stand-alone storage and dispensing unit, capable of independent use. FIG. 5 shows a cross-sectional view of two "discrete" tray modules 12 joined in a fixed relationship by a connecting member 14. FIG. 9 shows a bottom view of eight "discrete" tray modules 12 joined in a fixed relationship by a tie bar 50.

Each tray module 12 has a base 22, two vertical sides 26, a vertical rear side 28, and a front portion 24. Each tray module 12 is separately injection molded from high-impact polystyrene with a silicone additive. The silicone additive reduces friction between the cans 20 and tray modules 12 to promote sliding.

The width and length of the base 22 determines the size of the tray modules 12 and ultimately the size of the storage and dispensing rack 10. The width of the base 22 of the tray modules 12 is approximately 10% wider than the cans 20 stored on it so that the cans 20 can slide toward the front portion 24 of the tray module 12 without substantially interfering with the sides 26 of the tray module 12. The length of the base 22 allows eight to ten cans 20 to be stored on the base 22. This length also allows the storage and dispensing rack 10 to fit in most coolers used to store cans 20 of beer or soda.

FIGS. 1, 3, 4, 5, 6 and 7, show further details of the base 22. Specifically, the base 22 has a top side 30 and a bottom side 32, and a plurality of openings 34. The top side 30 of the base 22 has three different regions. The first region of the top side 30 an inclined area 36 located at the rear of the base 22. The inclined area 36 is sized so that one can 20 will rest on it. (See FIGS. 1, 3 and 4.) The purpose of the inclined area 36 is to create an additional force on the last can 20 resting on the tray module 12 so the can 22 will slide toward the front of the tray module 12. The second region of the top side 30 is two groups of ribbed areas 38, each area having five ribs 40. The ribs 40 run from the vertical rear side 28 of the tray module 12 up to a flat area (not shown in the drawings) at the front of the tray module 12. It is preferred that the points of all the ribs 40 are in the same plane as the surface of the flat area (not shown). The purpose of these ribs 40 is to reduce friction between the tray module 12 and the cans 20 stored on the tray module 12 so that the cans 20 will slide toward the front of the tray module 12 when the tray module 12 is inclined at a slope of approximately 7°. To further reduce the friction between the ribbed areas 38 and the cans 20, the ribbed areas 38 are diamond polished. The third region of the top side 30 is a flat area at the front of the tray module 12. The flat area (not shown) extends from the front portion 24 back to the ribbed area 38, and is sized so that one can 20 will rest on it. The purpose of this flat area is to increase friction between a can 20 moving along the tray module 12 and coming off the ribbed area 38, thereby slowing the moving can 20 down before it impacts with the front portion 24 of the tray module 12.

Figure 4:
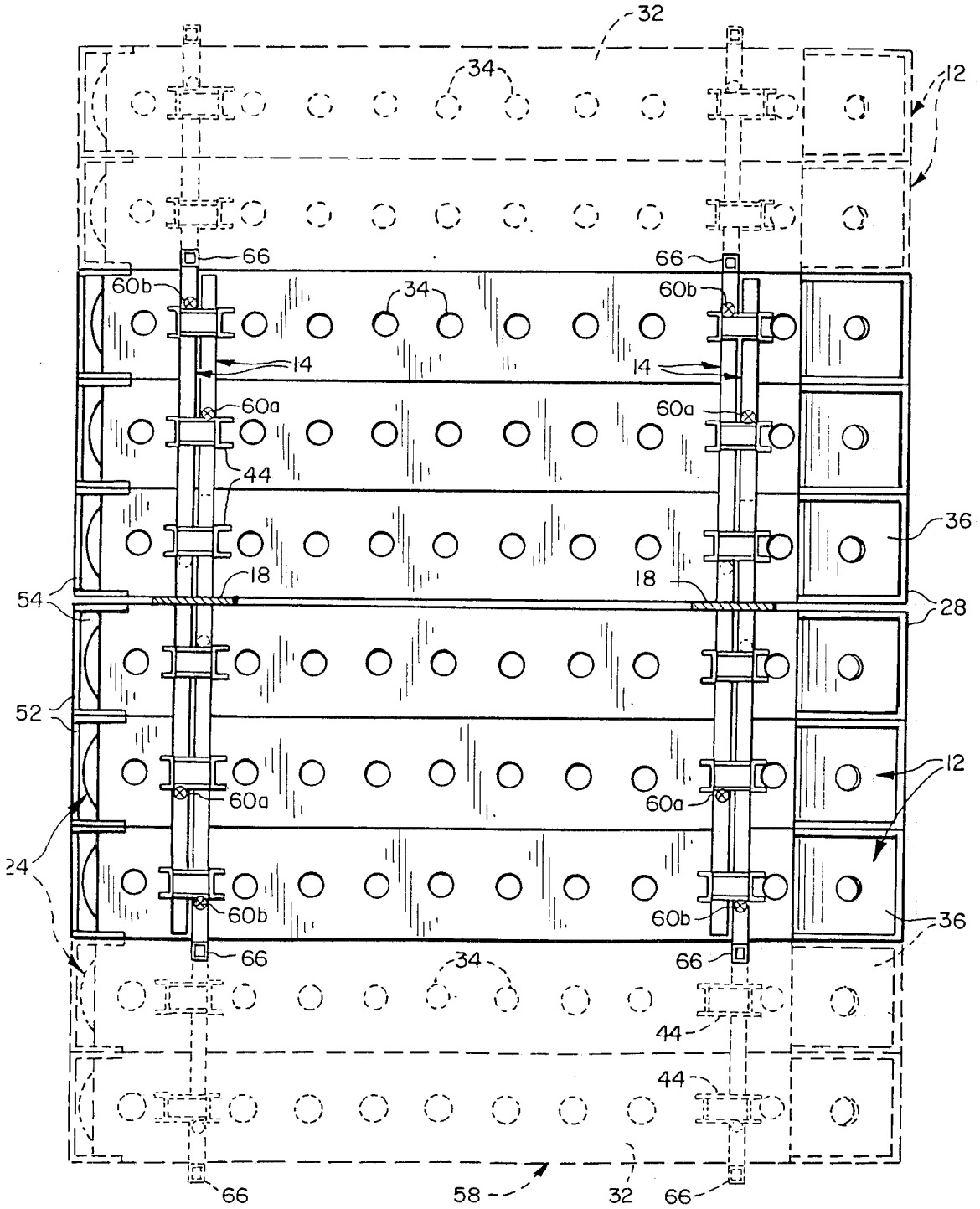
FIG. 4 is a bottom view of the top shelf of the storage and dispensing rack of FIG. 3 taken along line 4—4.
Figure 6:
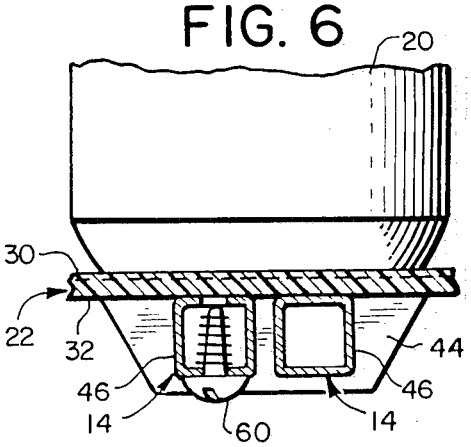
FIG. 6 is a cross-sectional view taken along lines 6—6 of FIG. 5.

The bottom side 32 of the base 22 has two saddles 44. These saddles 44 are located on the centerline of the base 22 which runs from the front end to the rear end of the base 22. As shown in FIG. 4, the first saddle 44 is located near the front of the tray module 12 and the second saddle 44 is located at the rear end of the tray module 12. The saddles 44 each have two openings 46 designed to receive two connecting members 14 fabricated from square tubing. The openings 46 are designed so that two connecting members 14 can pass through the saddle 44 in a side-by-side fashion. The twelve saddles 44 of the six center tray modules 12 illustrated in FIG. 4 each have two connecting members 14 passing through them in a side-by-side fashion. FIG. 6 illustrates a side view of the two openings 46 of a saddle 44 with two connecting members 14 passing through the openings 46. (The openings 46 of the saddles 44 are also designed to allow a tie bar 50 to pass through it. FIGS. 9, 10 and 11 illustrate an opening 46 of the saddles 44 with a tie bar 50 passing through them. The purpose of the saddle 44 is to connect the tray modules 12 to either connecting members 14 or tie bars 50.)

The base 22 also has a plurality of openings 34 passing through it. The openings 34 spaced along the centerline of the base 12. The spacing of the openings 34 is preferably designed so that each can 20 stored on the tray module 12 is located above at least a portion of an opening 34. In addition, the openings 34 must be spaced so that they will not interfere with the locations of the saddles 44 on the bottom side 32 of the base 22. FIGS. 1 and 4 illustrate the openings 34 spaced along the centerlines of the tray modules 12. In the preferred embodiment of the invention the openings 34 are round and have a diameter which is approximately 25% of the width of the tray module 12. This diameter will give the largest opening 34 without sacrificing the strength of the tray module 12. The openings 34 allow cooling air to circulate against the bottoms of the cans 20, and allow liquid build up in the tray modules 12 to drain from the tray modules 12. Liquid build up becomes a problem when condensation water from the cans 20 gathers in the tray modules 12 and when the liquid of a can 20 is spilled in the tray module 12.

Figure 7:
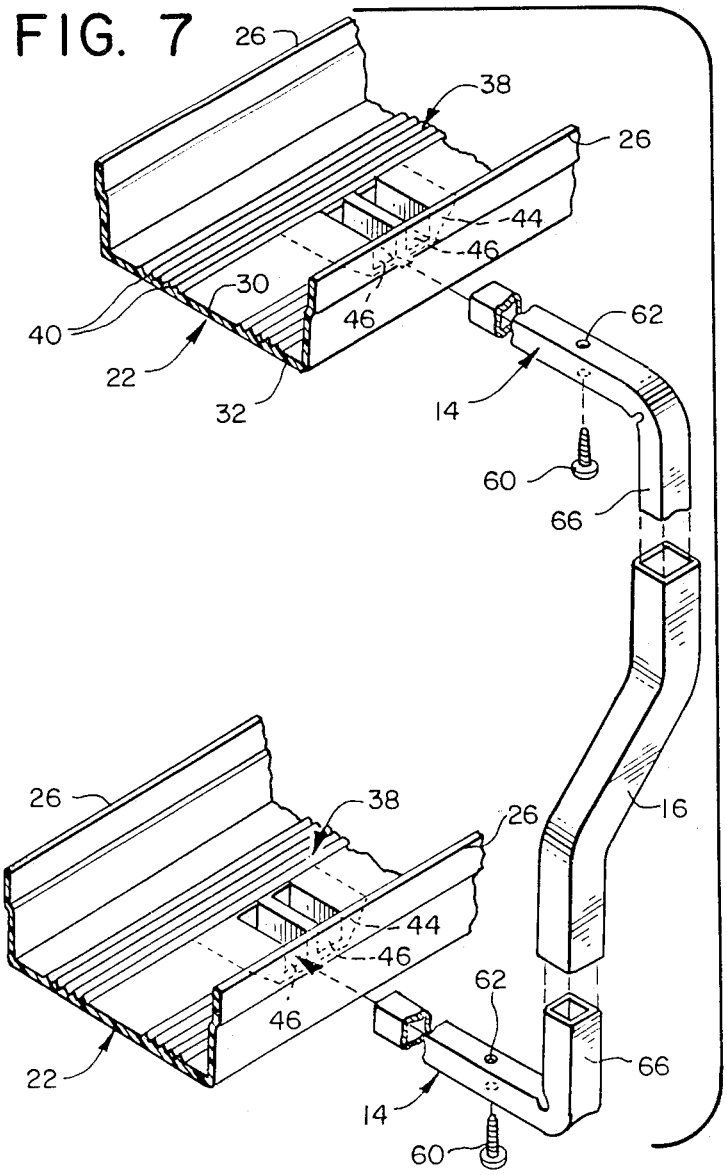
FIG. 7 is an exploded view of the structural relationship between the connecting members, tray modules and spacing members of the storage and dispensing rack shown in FIGS. 1–6.

Each side 26, 28 is perpendicular to the base 22. The base 22 of the tray module 12, is integral with two vertical sides 26 and a vertical rear side 28. The sides 26, 28 are designed to have a height which is approximately 25% of the height of the cans 20 stored on the tray module 12. The purpose of the sides 26, 28 is to prevent cans 20 from falling off the tray modules 12. In addition, the vertical sides 26 run along the length of the tray module 12 and prevent the tray module 12 from deflecting between the saddles 44 when loaded with cans 20. The vertical sides 26, running along the length of the tray modules 12, also separate the tray modules 12 from each other. This feature is important where different cans 20 are stored on different tray modules 12. FIG. 1 illustrates the two vertical sides 26 and the vertical rear side 28 of a tray module 12, while FIGS. 5, 7 and 10 illustrate the two vertical sides 26.

The front portion 24 of a tray module 12, shown in FIGS. 1, 2 and 3, consists of a front side 52, a contoured rib 54 and two stopping members 56. The front side 52 is integral with the base 22 and perpendicular to the base 22 at the front of the base 22. The contoured rib 54 runs along the top of the front side 52 between the two vertical sides 26. The contour of the contoured rib 54 is such that it fits the curved side of the cans 20 stored on the tray module 12. The stopping members 56 are attached to the contoured rib 54 and the vertical sides 26. The purpose of the front portion 24 is to stop the cans 20 sliding toward the front of the tray module 12 without denting them and without allowing the cans 20 to tumble over the front side 52 of the tray module 12. The contoured rib 54 reduces denting of the cans 20 by increasing the area of contact between the moving cans 20 and the front portion 24 of the tray module 12. The increase in contact area reduces the impact force per unit area between the front portion 24 and the can 20.

Connecting members 14 are used to join the tray modules 12 together in a side-by-side relationship to form a shelf 58. The connecting members 14 are fabricated from square steel tubing and are designed to fit in and pass through the-openings 46 of the saddles 44. (Each connecting member 14 has a longitudinal axis which runs along the length of the connecting member 14.) Once the tray modules 12 are joined by the connecting members 14, screws 60 are used to prevent relative movement between the connecting members 14 and the tray modules 12. The solid lines of FIG. 4 illustrate six tray modules 12 fixed in a side-by-side relationship by four connecting members 14. The dashed lines of FIG. 4 illustrate four additional tray modules 12. These four tray modules 12 can be fixed in a side-by-side relationship with the six original tray modules 12 by adjusting the connecting members 14. Each connecting member 14 is adjusted so that it passes through one saddle 44 of two of the added tray modules 12 and one saddle 44 of four of the original tray modules 12.

To join the tray modules 12 in a side-by-side relationship to form a shelf 58, the tray modules 12 must be placed alongside of each other so that all of their front portions 24 are facing forward and their top sides 30 are facing in an upward direction. In addition, each tray module 12 of the shelf 58 must abut the adjacent tray module at the vertical side 26 of the adjacent tray module 12. FIGS. 1, 2 and 4 illustrate the tray modules 12 in the previously described side-by-side relationship.

After the tray modules 12 are placed in a side-by-side relationship, a first connecting member 14 is passed from the first side of the tray modules 12 through the first openings 46 of some or all of the front saddles 44 of the tray modules 12. Next a second connecting member 14 is passed from the second, opposite side of the tray modules 12 through the second openings 46 of some or all of the front saddles 44 of the tray modules 12. Next a third connecting member 14 is passed from the first side of the tray modules 12 through the first openings 46 of some or all of the rear saddles 44 of the tray modules 12. Finally, a fourth connecting member 14 is passed from the second, opposite side of the tray modules 12 through the second openings 46 of some or all of the rear saddles 44 on the tray modules 12. To maintain the integrity of the shelf 58, the first and second connecting members 14 must both pass through at least one common front saddle 44 and the third and fourth connecting members 14 must both pass through at least one common rear saddle 44. In other words, the first and second connecting embers 14 must overlap, and the third and fourth connecting members 14 must overlap. The first and second connecting members 14 and/or the third and fourth connecting members 14 will sometimes be referred to as opposed connecting member pairs.

Once the connecting members 14 are in place, two screws 60 are inserted into screw holes 62 in each connecting member 14 so that the first screw 60*a* abuts the outside side of the second to last saddle 44 the connecting member 14 passes through and the second screw 60*b* abuts the outside side of the first saddle 44 the connecting member 14 passes through. FIG. 4 illustrates the way in which the connecting members 14 pass through the saddles 44 and the way in which the screws 60 abut the saddles 44. Preferably the screw holes 62 should be drilled so they will accept self tapping screws 60 and so that the screws 60 will abut a saddle 44 when the connecting members 14 are fully inserted in the saddles 44. It will be apparent that when inserted, the screws 60 prevent the connecting members 14 from being slid out of, or removed from, the saddles 44 through which they pass.

The connecting members 14, used to fix the tray modules 12 in a side-by-side relationship to form a shelf 58, are not replaced when the number of tray modules 12 changes. Due to their fixed length, the connecting members 14 can only pass through the saddles 44 of a fixed number of tray modules 12 (e.g., six trays in FIG. 4). The maximum number of tray modules 12 through which a connecting member 14 can pass is the "tray capacity" of the connecting member 14. The "tray capacity" will represent the minimum number of tray modules 12 which must comprise a shelf 58, since the opposed connecting member pairs will pass through the saddles 44 of every tray module 12 in the shelf 58. And since the opposed connecting member pairs should pass through at least three common saddles 44, the maximum width of the shelf 58 is limited to twice the tray capacity less three tray modules 12.

The reason for joining tray modules 12 in the manner just described to form a shelf 58 is to allow the shelf 58 to be quickly, easily and efficiently expanded or contracted by adding or removing tray modules 12 and adjusting the connecting members 14. Referring to FIG. 4, to change the width of a shelf 58, the connecting members 14 are removed from the shelf 58 by removing only the first screw 60*a* and sliding the connecting member 14 out of all saddles 44. Tray modules 12 are then added or removed. (Removed tray modules 12 should be saved for future use.) After the desired number of tray modules 12 are placed in a side-by-side relationship, the connecting members 14 are fully reinserted into the saddles 44 of the tray modules 12, so that the second screw 60*b* abuts the outside of the first saddle 44 through which the connecting member 14 passes. The first screw 60*a* is then reinserted into the connecting member 14 in a hole 62 adjacent the outside of the last saddle 44 through which the connecting member 14 passes, so that the tray modules 12 are fixed in a side-by-side relationship.

The connecting members 14 are used in cooperation with spacing members 16, fabricated from square steel tubing, to support a second shelf 58 above a bottom shelf 58. FIGS. 1, 2 and 3 illustrate a second shelf 58 supported above a bottom shelf 58 with spacing members 16.

The connecting members 14 joining the second shelf 58 and bottom shelf 58 all have end portions 66 bent at a 90° angle to the connecting member 14 and extending beyond the outer sides of the shelves 58. (The method of bending the connecting members 14 must provide for sharp corners.) The end portions 66 of the connecting members 14 of the bottom shelf 58 are bent in the upward direction, while the end portions 66 of the second shelf 58 are bent in the downward direction. The square steel tubing forming the spacing members 16 is sized so that the spacing members 16 will slide over the end portions 66 of the connecting members 14. After the bottom shelf 58 is assembled, a spacing member 16 is slid on each of the end portions 66 of the connecting members 14. Next, the second shelf 58 is located above the bottom shelf 58, and the end portions 66 of the connecting members 14 of the second shelf 58 are slid into the spacing members 16. The spacing members 16 are angled backwards so the second shelf 58 is offset above the bottom shelf 58 to allow removal of cans 20 from the bottom shelf 58. FIGS. 1 and 3 illustrate the angled spacing members 16. Different length spacing members 16 are used to vary the height between shelves 58 so that bottles (e.g., 16 oz.) can also be stored and dispensed on the shelves 58.

Figure 8:
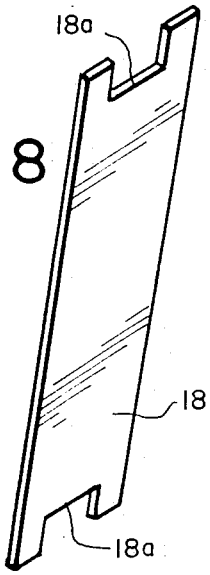
FIG. 8 illustrates a separating member which is used to support the center of upper shelf of the storage and rack as shown in FIGS. 1–7.

In addition to spacing members 16, two separating-members 18, made from flat bar, are used to support the second shelf 58 above the bottom shelf 58 near the center of the shelves 58. Each end of the separating member 18 has a notch 18*a* which is designed to straddle two overlapping, opposed connecting members 14. (See FIGS. 3 and 8.) FIG. 2 illustrates a first separating member 18 centrally supporting the front second shelf 58 above the bottom shelf 58 and angled towards the back of the shelves 58. A second separating member 18 is located directly behind the first separating member 18, and straddles the overlapping connecting members 14 passing through the rear saddles 44 of the bottom and top shelves 58. (See FIGS. 3 and 4.) It is important that each separating member 18 is positioned between the same tray modules 12 (e.g., the fourth and fifth) of the top and bottom shelves 58. The purpose of the separating member 18 is to prevent sagging in the second shelf 58 when the shelves 58 are expanded to the maximum number of tray modules 12 and fully loaded with cans 20 or heavier bottles (e.g., 16 oz).

To supply the incline needed to slide the cans 20 to the front of the tray modules 12, the completed rack 10 can be supported by an inclined shelf 68. (See FIG. 3.)

FIG. 9 illustrates a second preferred embodiment of the storage and dispensing rack 10 having a single shelf 58. The same discrete tray modules 12 and their integral components described above are used in this embodiment. The primary difference between this second embodiment and the first embodiment is the manner in which a plurality of the tray modules 12 are joined together in a side-by-side relationship to form the shelf 58.

Specifically, a tie bar or cross member 50 and hinge pins 72 are used to join the tray module 12 in a side-by-side relationship. The tie bar 50 can be fabricated from flat bar, and is designed to include weakened areas 74 and pin receiving holes 76. The tie bar 50 is sized to pass through the square saddle openings 46 on their diagonals. (See FIG. 11.) The tie bar 50 must fit tightly in the square openings 46 so that the tray modules 12 will not rock on the tie bar 50. The weakened areas 74 are manufactured by passing a hole 78 through the tie bar 50 and then placing a score mark 80 above and below the center of the hole 78. (See FIG. 12.) The weakening holes 78 and score marks 80 are designed to allow the tie bar 50 to be broken off at a score mark 80 when flexed there. The pin receiving holes 76 are placed along the centerline (or longitudinal axis) of the tie bar 50. These pin receiving holes 76 are sized so that a hinge pin 72 of appropriate size can pass through the hole 76. The pin receiving holes 76 are spaced along the tie bar 50 so that they will be adjacent the outer edge of a saddle 44 when the tie bar 50 is fully inserted through a plurality of tray modules 12. (See FIG. 9). The weakening holes 78 and score marks 80 are positioned just beyond each pin receiving hole 76, so that when a portion of the tie bar 50 is broken off, the pin receiving hole 76 on the remaining portion of the tie bar 50 will be located adjacent to the outer edge of the saddle 44 of the last tray module 12 in the shelf 58. Moreover, the end of the remaining tie bar 50 will extend past the last pin receiving hole 76. This reduces the risk of the end of the tie bar 50 from slipping within the plastic saddle 44, a condition which could allow the outermost tray module 12 to rock, and thereby lose some support. On the other hand, the end of the tie bar 50 extending past the last pin receiving hole 76 will be minimal, so that it will not extend beyond the outermost edge of the shelf 58. The number and location of the pin receiving holes 76, weakening holes 78 and score marks 80 determines the minimum number of tray modules 12 which must be used in a shelf 58. Presently, the tie bar 50 is designed to accommodate five to nine tray modules 12. FIG. 12 illustrates the tie bar 50 with weakened areas 74 and pin receiving holes 76.

To assemble the single shelf 58 of this embodiment, the desired number of tray modules 12 are placed in a side-by-side relationship. A first tie bar 50 is then passed through an opening 46 of the front saddles 44 of all of the selected tray modules 12. Next, a second tie bar 50 is passed through an opening 46 of the rear saddles 44 of all of the selected tray modules 12. Once the tie bars 50 are in place, two hinge pins 72 are inserted into each tie bar 50 to prevent relative motion between each tie bar 50 and the tray modules 12. FIG. 9 illustrates an assembly of a tie bar 50, two hinge pins 72, and eight tray modules 12. Two hinge pins 72 are inserted into the tie bar 50 so that the first hinge pin 72*a* abuts the outside side of the saddle 44*a* of the first tray module 12*a*. The second hinge pin 72*b* abuts the outside side of the saddle 44*b* of the last tray module 12*b*. While only the front tie bar 50 is shown in FIG. 9, it will be readily apparent from FIGS. 4 and 9 that the rear tie bar 50 will pass through the rear saddles 44 of the tray modules 12 in the same manner.

The weakened areas 74 facilitate breaking off portions of the tie bar 50 when the width of a shelf 58 is decreased. To decrease the width of a shelf 58, a hinge pin 72 is removed from the end of each tie bar 50 so that tray modules 12 can be removed until the desired shelf 58 width is obtained. (The removed tray modules 12 should be saved for future use.) After the desired shelf 58 width is obtained, the tie bars 50 are broken off to a length that corresponds to the distance between the saddles 44 of the first and last tray modules 12 of the reduced width shelf 58. Finally, the hinge pins 72 are then reinserted into the outermost holes 76 of the shortened tie bar 50, so that the hinge pins 72 abut the outer sides of the first and last saddles 44 to fix the tray modules 12 in a side-by-side relationship.

It should be understood that various changes and modifications to the preferred embodiments described herein will be apparent to those skilled in the art. For example, equivalent forms of connecting members or tie bars, such as telescoping members, could be used to join and support the tray modules 12. Such changes and modifications can be made without departing from the spirit and scope of the present invention and without diminishing its attendant advantages. It is therefore intended that all such changes and modifications be covered by the appended claims.

I claim:

1. A rack for storing and dispensing articles comprising:

a plurality of discrete tray modules, each tray module having a top side for storing and dispensing articles, and a bottom side;

a connector receiving means attached to the bottom side of each tray module; and a connector means for joining a plurality of the discrete tray module in a side-by-side relationship to form a rack, the connector means including a first connecting member adapted to pass through a first side of a first connector receiving means to a second side of the first connector receiving means, a second connecting member adapted to pass through the second side of the first connector receiving means to the first side of the first connector receiving means, and means for preventing relative motion between the tray modules and the first and the second connecting members.

2. A rack for storing and dispensing articles, comprising:

a plurality of discrete tray modules, each tray module having a top side for storing and dispensing articles, and a bottom side;

a first connecting member and a second connecting member adapted to join a plurality of the tray modules in a side-by-side relationship to form a shelf;

at least one saddle attached to the bottom side of each tray module and adapted to receive the first and second connecting members, wherein the first connecting member passes through the saddles of a first group of the tray modules from one direction and the second connecting member passes through the saddles of a second group of the tray modules in the opposite direction, the first and second connecting members cooperating to join the tray modules of the first and second groups in the side-by-side relationship to form the rack; and means for preventing relative motion between the tray modules joined by the first and second connecting members.

3. The rack of claim 2 wherein:

the first and second connecting members each define a longitudinal axis;

each saddle has a first and a second opening, wherein the first opening is adapted to receive the first connecting member and the second opening is adapted to receive the second connecting member; and the saddles are attached to the bottom side of the tray modules so that the longitudinal axes of the first and second connecting members passing through the first and second openings are perpendicular to the direction in which articles may be stored and dispensed on the tray modules.

4. The rack of claim 2 wherein the means for preventing relative motion includes a plurality of screws, the screws being inserted into the connecting members in positions adjacent to the saddles to prevent the connecting members from being removed from the saddles.

5. The rack of claim 2 further comprising:

a bottom shelf and a second shelf, wherein the connecting members of the shelves each include an end portion bent at a right angle to the connecting member and extending beyond a side of one of the shelves, wherein each end portion of the connecting members of the bottom shelf is bent in an upward direction and each end portion of the connecting members of the second shelf is bent in a downward direction; and a plurality of spacing members adapted to support the second shelf above the bottom shelf and adapted to connect with a connecting member of the bottom shelf and a connecting member of the second shelf, wherein the second shelf is supported above the bottom shelf to allow movement of articles on the bottom shelf.

6. A rack for storing and dispensing articles comprising:

a plurality of discrete tray modules, each tray module having a top side, for storing and dispensing articles, and a bottom side;

a plurality of connecting members adapted to join a plurality of tray modules in a side-by-side relationship to form a bottom shelf and a second shelf, each connecting member including an end portion extending beyond a side of the shelves and bent at a right angle to the connecting member, wherein the end portions of the bottom shelf connecting members are bent in an upward direction while the end portions of the second shelf connecting members are bent in a downward direction;

at least one saddle attached to the bottom side of each tray module, and adapted to receive a first connecting member and a second connecting member, wherein the first connecting member passes through the saddles of a first group of the tray modules from one direction and the second connecting member passes through the saddles of a second group of tray modules from the opposite direction, the first and second connecting members cooperating to join the tray modules of the first and second groups in the side-by-side relationship;

a plurality of spacing members adapted to support the second shelf above the bottom shelf, each spacing member adapted to connect with an end portion of a connecting member of the bottom shelf and an end portion of a connecting member of the second shelf, wherein the second shelf is supported above the bottom shelf to allow movement of articles on the bottom shelf; and means for preventing relative motion between the tray modules joined by the first and second connecting members.

7. The rack of claim 6 wherein:

the first and second connecting members each define a longitudinal axis;

each saddle has a first and a second opening wherein the first opening is adapted to receive the first connecting member from one direction and the second opening is adapted to receive the second connecting member from the opposite direction; and the saddles are attached to the bottom side of the tray modules so that the longitudinal axes of the first and second connecting members passing through the first and second openings are perpendicular to the direction in which articles may be stored and dispensed on the tray modules.

8. The rack of claim 6 wherein the means for restraining relative motion includes a plurality of screws, the screws being inserted into the connecting members to prevent the connecting members from being removed from the saddles.

9. A rack for storing and dispensing articles comprising:

a plurality of discrete tray modules, each tray module having a front end, a rear end, a top side and a bottom side, wherein the top side is used for storing and dispensing articles;

a plurality of connecting members adapted to join a plurality of tray modules in a side-by-side relationship to form a bottom shelf and a second shelf, each connecting member including an end portion extending beyond a side of one of the shelves and bent at a right angle to the connecting member, wherein the end portions of the bottom shelf connecting members are bent in an upward direction while the end portions of the second shelf connecting members are bent in a downward direction;

first and second saddles attached to the bottom side of each tray module, each saddle having a first opening and a second opening adapted to receive a first and a second connecting member, wherein the first saddle is positioned near the front end of each tray module and the second saddle is positioned near the rear end of each tray module and wherein the first connecting member passes through the saddles of a first group of the tray modules from one direction and the second connecting member passes through the saddles of a second group of the tray modules in the opposite direction, the first and second connecting members cooperating to join the first and second groups of tray modules in the side-by-side relationship; and a plurality of screws, the screws being inserted into the connecting members in positions adjacent to the saddles to prevent the connecting members from being removed from the saddles and to prevent relative movement between the tray modules and connecting members.

10. The rack of claim 9 wherein the rack includes between 5 and 9 discrete tray modules.

* * * * *